US006309193B1

(12) United States Patent
Repple et al.

(10) Patent No.: US 6,309,193 B1
(45) Date of Patent: Oct. 30, 2001

(54) COOLANT PUMP FOR AUTOMOTIVE USE

(75) Inventors: Walter O Repple, Dundas (CA); John R L Fulton, Royal Oak, MI (US)

(73) Assignee: Flowork Systems Inc., Royal Oak, MI (US)

( * ) Notice: Subject to any disclaimer, the term of this patent is extended or adjusted under 35 U.S.C. 154(b) by 0 days.

(21) Appl. No.: 09/125,861

(22) PCT Filed: Feb. 25, 1997

(86) PCT No.: PCT/CA97/00123

§ 371 Date: Aug. 23, 1998

§ 102(e) Date: Aug. 23, 1998

(87) PCT Pub. No.: WO97/32131

PCT Pub. Date: Sep. 4, 1997

(30) Foreign Application Priority Data

Feb. 26, 1996 (GB) ..... 9604042

(51) Int. Cl.[7] ..... F04B 17/00

(52) U.S. Cl. ..... 417/423.8; 417/279; 417/292; 417/295

(58) Field of Search ..... 417/423.8, 366, 417/279, 292, 295, 364; 62/227

(56) References Cited

U.S. PATENT DOCUMENTS 2,885,963 * 5/1959 Ivanoff ..... 417/423.8
3,229,896 * 1/1966 Levy ..... 417/423.8
3,771,318 * 11/1973 Roberts ..... 62/227
3,969,040 * 7/1976 Hamm et al. ..... 417/292
4,164,690 * 8/1979 Muller ..... 318/254
4,974,427 * 12/1990 Diab ..... 417/292
5,226,787 * 7/1993 Freeman ..... 417/364

FOREIGN PATENT DOCUMENTS 41 42 120 * 6/1993 (DE) .
56-121895 * 9/1981 (JP) .

* cited by examiner

*Primary Examiner*—Charles G. Freay
*Assistant Examiner*—Cheryl J. Tyler
(74) *Attorney, Agent, or Firm*—Anthony Asquith & Co.

(57) ABSTRACT

An impeller pump with thermostatically adjustable guide vanes is suitable for use as an automotive coolant pump. The pump is driven by a constant speed electric motor, and flow variation is controlled by varying the orientation of the vanes. Orientation of the vanes is effected by a wax-type thermostat, which senses coolant temperature: flow is increased when the coolant is hot, and decreased as the coolant cools. The variable guide vanes are mounted for pivoting about radial axes, and are located just upstream from the pump impeller.

20 Claims, 10 Drawing Sheets

COOLANT PUMP FOR AUTOMOTIVE USE

BACKGROUND OF THE INVENTION

This invention relates to coolant pumps for automotive internal-combustion engines. The invention is aimed at providing a coolant pump which delivers flow characteristics in accordance with engine demand.

Pumps for internal-combustion engine cooling systems have traditionally been belt-driven, at a fixed ratio, directly from the engine.

The coolant flow rate and pressure head required to effectively control the engine temperature are not, however, optimal when driven proportionally to the engine's rotational speed. The coolant system has to cope with the fully-laden vehicle struggling up-hill on a hot day, and the same system has to make sure the heater warms up rapidly in very cold conditions. Also, for efficiency, the energy consumed by the coolant pump ideally should at all times be only minimum needed to just achieve the optimum temperature in the coolant. Whatever coolant circulation system is used, it must of course cater for the extremes; in the case of the traditional belt-driven coolant pumps, the need to cater for the extremes so compromises the efficiency of normal running that traditional coolant pumps are inherently non-optimal for most of their operating conditions.

The optimum coolant temperature is dictated by considerations of engine performance, fuel efficiency, exhaust emissions, etc. The coolant circulation system must provide a volumetric flow rate, and a pressure head, such that the coolant is cooled down (or warmed up) to the correct temperature under the extreme conditions. The invention is aimed at making it possible still to accommodate the extremes, and yet to improve the efficiency of the coolant circulation system during normal running, so that the system consumes only a minimum of energy during normal running.

When the coolant pump provides excessive flow and head, the engine wastes power and the overall engine efficiency is reduced.

When the coolant pump provides insufficient coolant flow and head, the engine runs too hot, thereby reducing engine performance, and perhaps damaging the engine.

Engine designers have not, in general, switched to driving coolant pumps by means of electric motors. This fact should be viewed in light of the fact that it is very common for a designer to specify that the engine's cooling fan to be driven by an electric motor. There, the motor runs at constant speed, and is controlled simply by being switched on/off: the need for switching is signalled by a simple electrical thermostat. That is a simple enough duty requirement for an electric motor to be subjected to.

It is recognised, however, that a simple on/off control would be far too crude for controlling the flow of coolant. Even under the minimum coolant flow conditions, the coolant must still be pumped and circulated quite vigorously.

It might be considered that, if an electrically-driven coolant pump were to be provided, it would be possible to control the coolant flow by controlling the rotational speed of the electric motor. Theoretically, this could be done by varying the electric current supplied to the motor that drives the coolant pump. However, such control of the motor speed by control of the motor current has not found favour with engine designers.

Thus, in considering the use of an electric motor to drive the coolant pump, it is apparent, first, that simple thermostatic on/off switching of a pump motor is out of the question, and second, trying to control motor-speed by controlling the current supplied to the electric motor has not found favour. And, even as a last resort, the notion of controlling coolant-flow by means of coupling the pump to a fixed speed motor by means of a mechanical variable speed drive, must be contra-indicated out as being far too elaborate; also, as mentioned, it is important that the pump, as well as the motor, should run at constant speed.

The invention is aimed at making it possible to vary the coolant flow to suit many different conditions, in a way which allows the pump (and hence the motor) to run at constant speed.

GENERAL PRINCIPLES OF THE INVENTION

The design configurations as will be described herein employ variable pitch guide vanes to affect the velocity, flow rate, pressure head, etc. of the coolant. The guide vanes are located adjacent to the impeller of the coolant pump, in the flow of coolant as it passes through the pump. The vanes are operated in response to a temperature signal corresponding to the actual cooling demand of the engine. The guide vanes serve to boost or to reduce the flow of coolant through the impeller, the change between boost and reduce being effected as a consequence of a change in the positional orientation of the vane in relation to the impeller of the pump.

The heat rejection demand is made dependent upon the temperature of the system, not engine speed. The system temperature might, for example, be taken as the temperature of the cooling fluid, or the temperature of a particular location on a machine, such as near the exhaust valve on the cylinder heads of an internal combustion engine. The system temperature may be transduced into a mechanical displacement which adjusts the pitch of a set of the guide vanes, which are preferably located just upstream of the impeller. When the system temperature is high, the thermostatic transducer adjusts the vanes such that the impeller pump provides a high coolant flow rate; when the system temperature is low the vanes are adjusted to provide a lower coolant flow rate.

It should be noted that, in an internal combustion engine, it is required that the coolant flow be maintained at all times during operation of the engine. The minimum flow demand is still a substantial flow. The engine would overheat in a few seconds if flow were actually to stop. Thus, it will be understood that the flow rate being controlled is just the upper fraction of the maximum flow rate-an area of flow in which it is notoriously difficult for a designer to achieve a desired degree of linearity of control. It is recognised that controlling just the upper fraction of the flow rate is not only easy with the variable pitch vanes, but, when the vanes are moved, the change in flow rate is not too far from being more or less linearly proportional to the movement of the vane. This means that simple automotive wax-type thermostats can be used directly, since they too have a more or less linear temperature/movement characteristic.

The use of variable pitch guide vanes combined with a modern high-speed impeller produces increased hydrodynamic flow efficiency over a wide range of flow rates, and provides capability to reduce the flow rate when the demand decreases. In contrast to a conventional direct drive impeller pump which frequently provides excessive coolant flow and uses excessive power, the temperature-responsive variable vane system as described herein, can provide precisely the correct amount of coolant flow to maintain optimum system operating temperatures, while consuming less power.

This pump's variable hydrodynamic flow/pressure capability, even though driven at a reasonably constant speed, provides thermal controllability while eliminating the need for a variable or multiple speed electrical motor. Increased hydrodynamic flow efficiency combined with the use of small high-speed motors can result in the overall pump package being small, lightweight, efficient, and easy to integrate within a given cooling system's special constraints.

The thermostatic signal can be transduced directly into a mechanical displacement of the guide vanes, for simple systems. For more sophisticated systems, a thermal signal can be processed by the engine management system which then controls an electrically-activated displacement mechanism to adjust the guide vanes.

DETAILED DESCRIPTION OF PREFERRED EMBODIMENTS

By way of further explanation of the invention, exemplary embodiments of the invention will now be described with reference to the accompanying drawings, in which.

Figures 2, 2A:
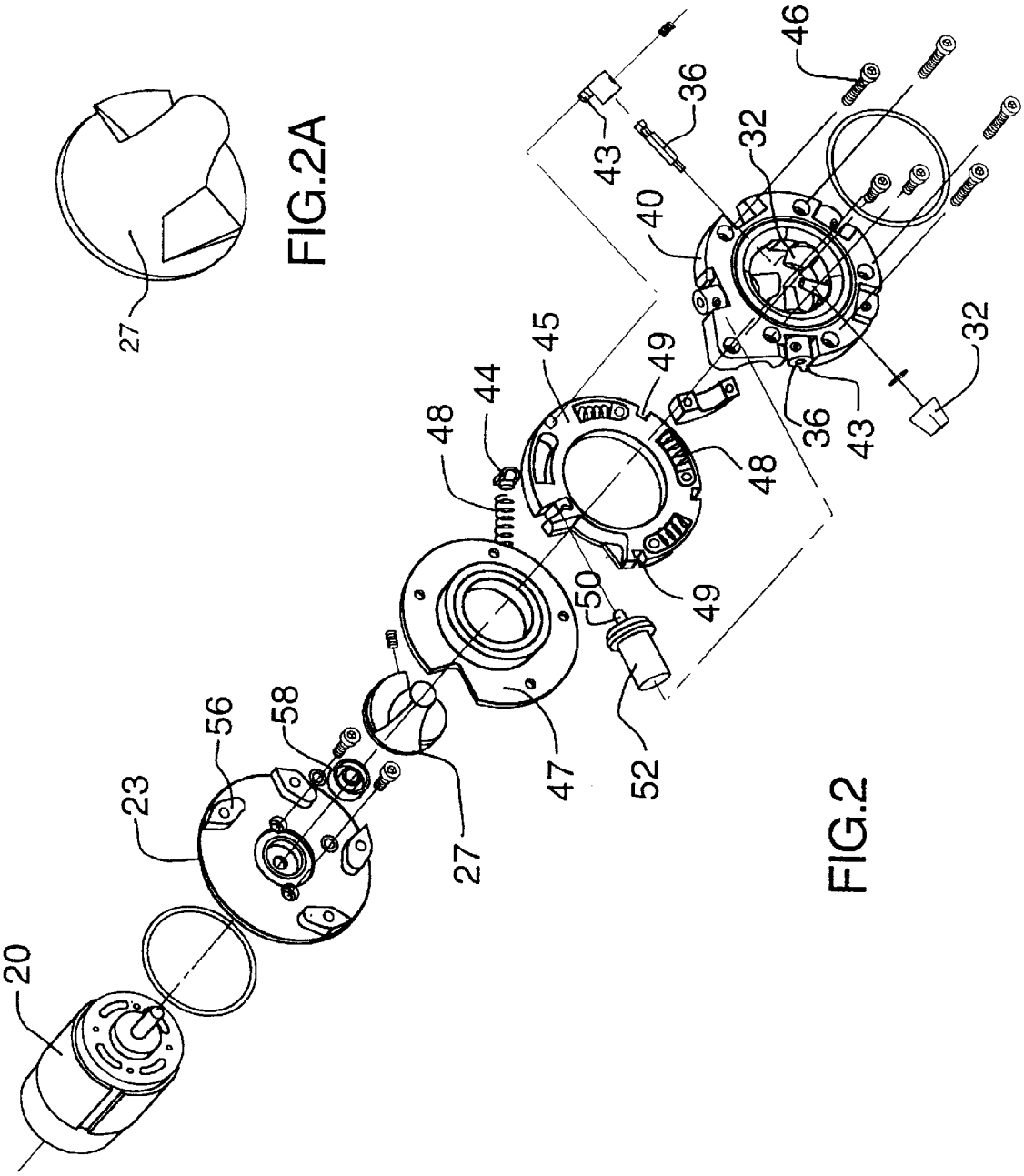
FIG. 2 is a pictorial exploded view of the components of a water pump for an automotive engine, which embodies the invention.
Figure 3:
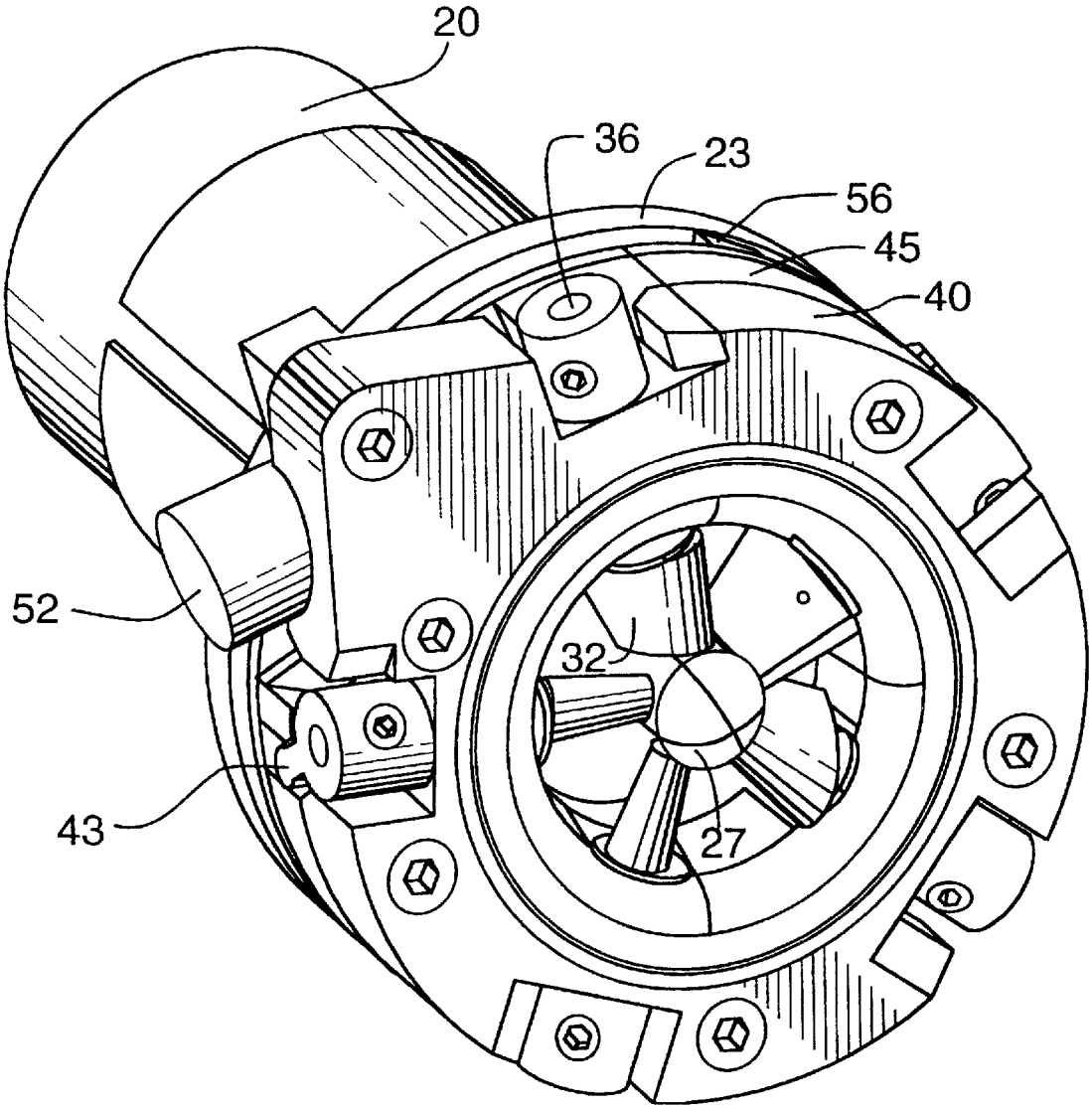
Figure 4:
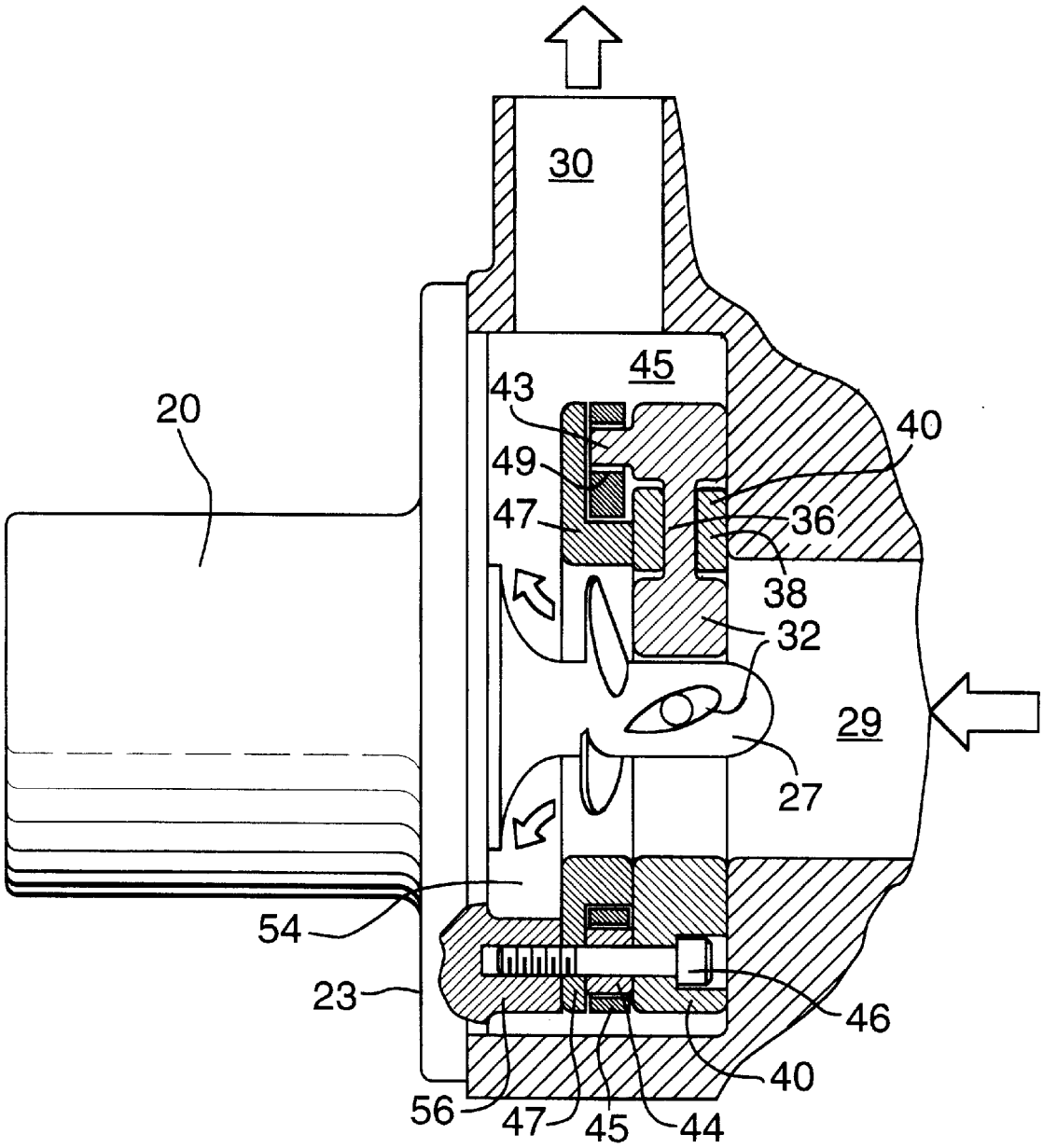
Figure 5:
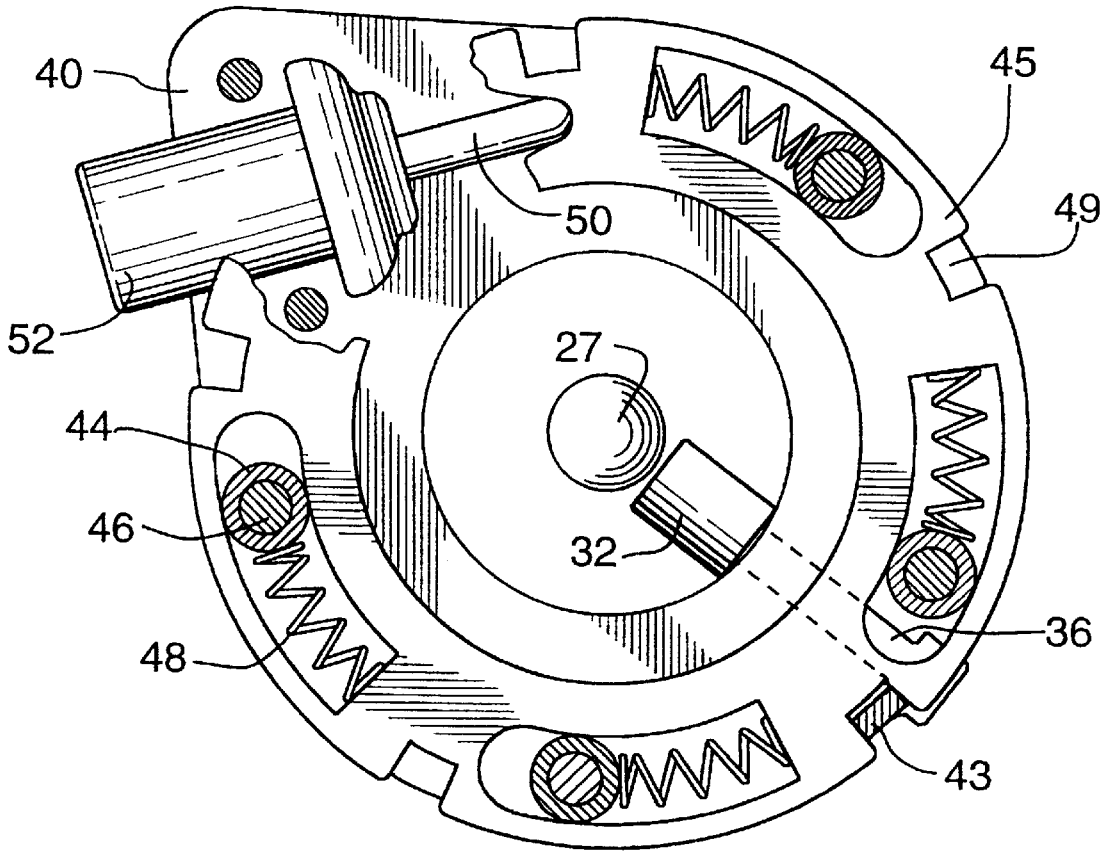
Figure 6:
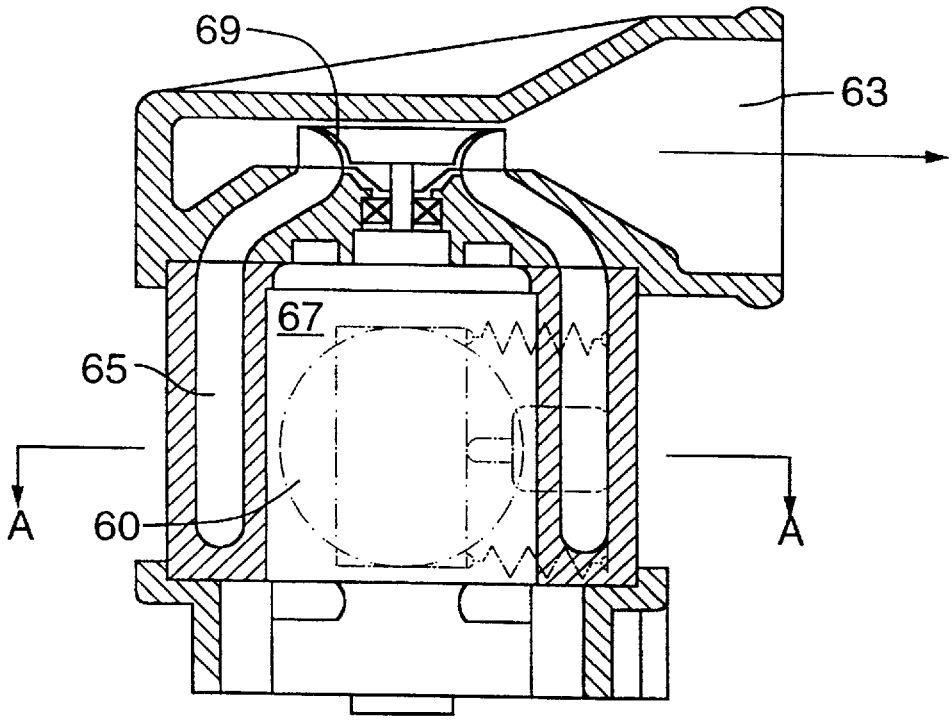
Figure 7:
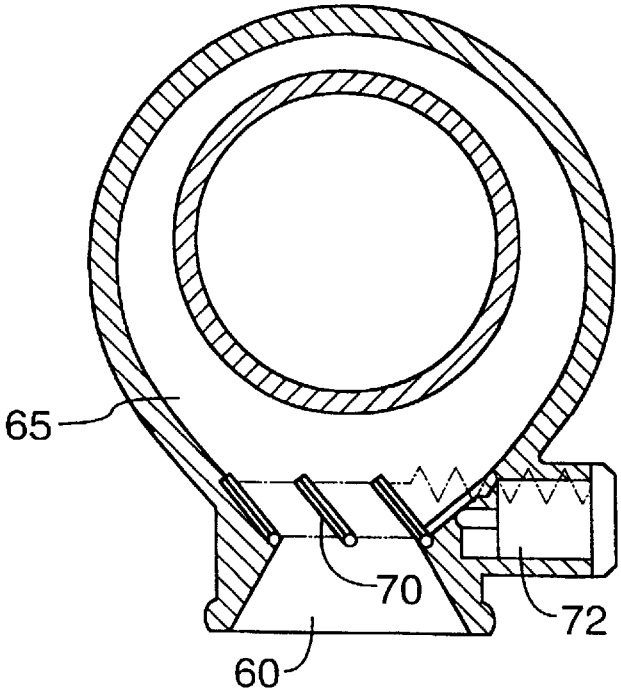
Figure 8:
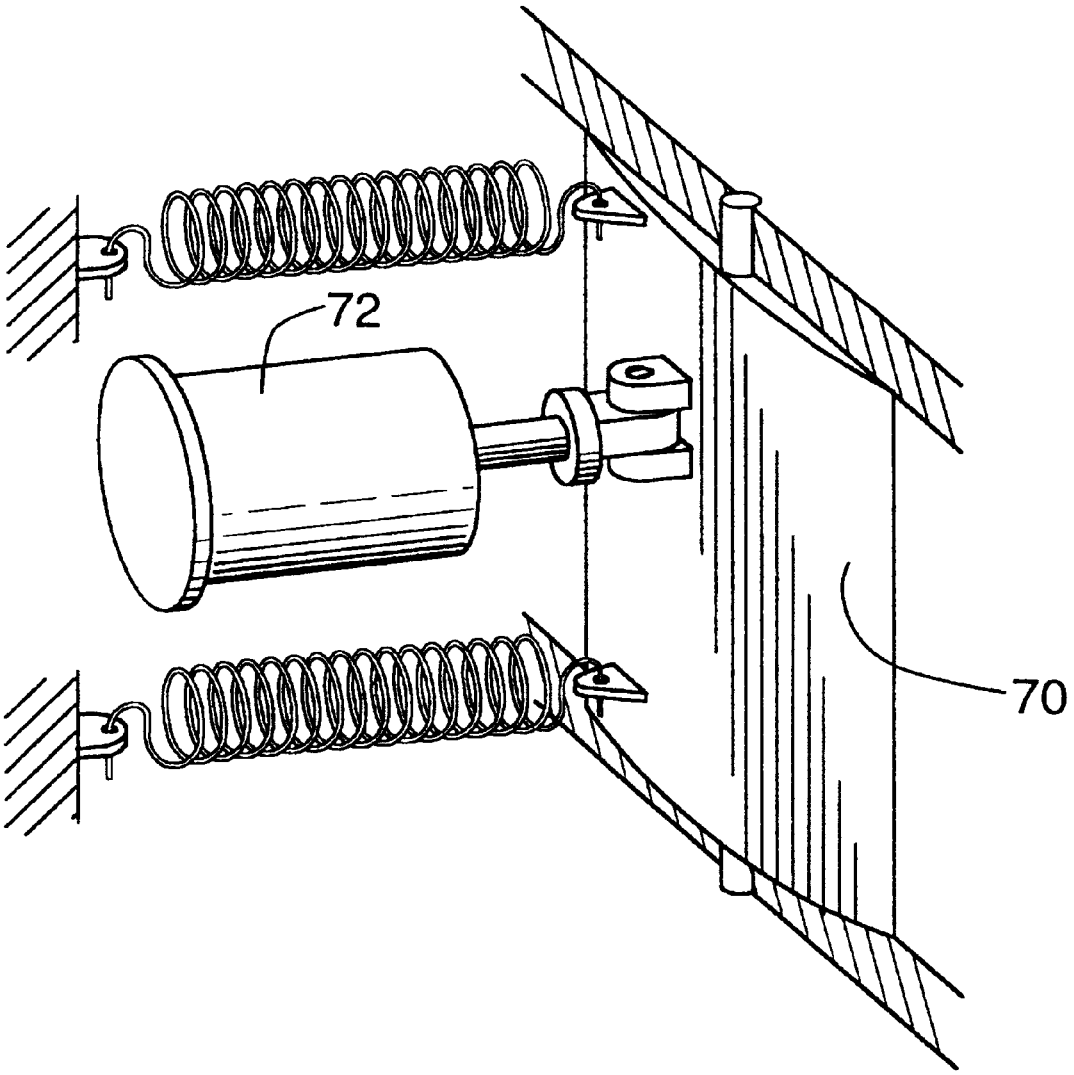
Figure 9:
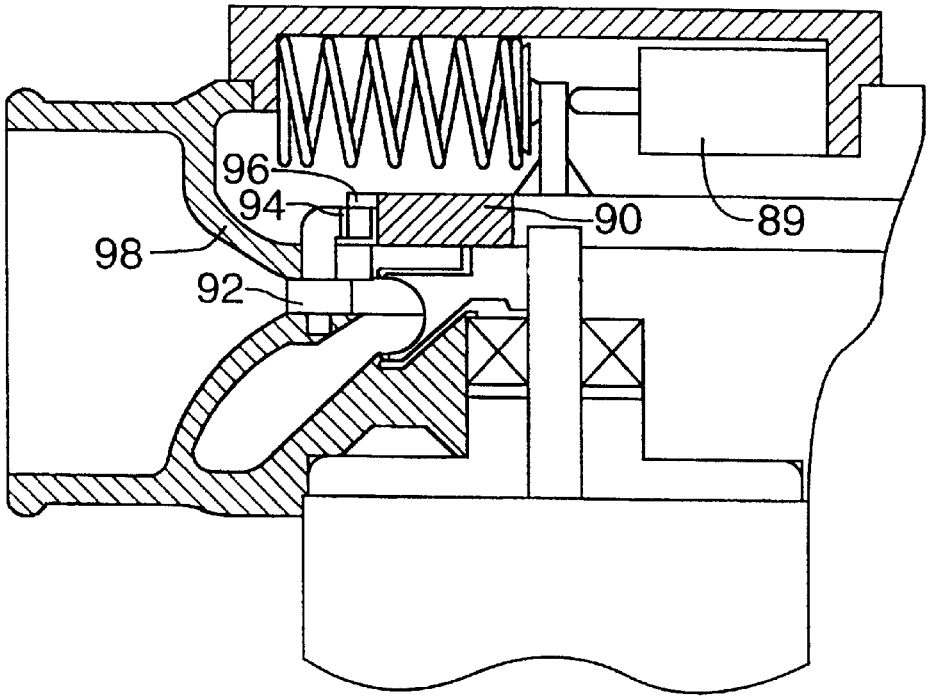
Figure 10:
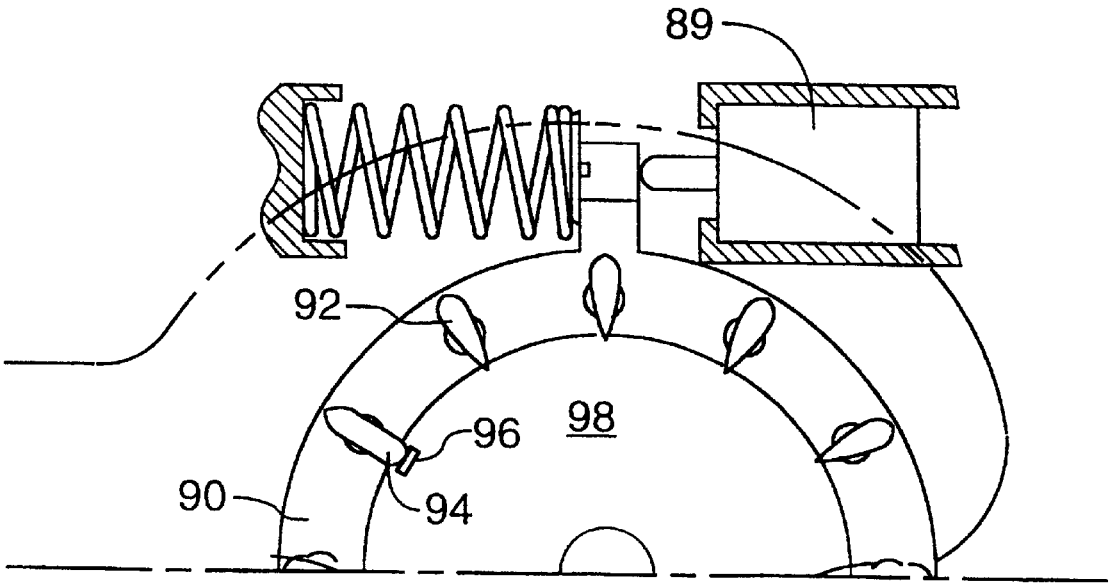
Figure 11:
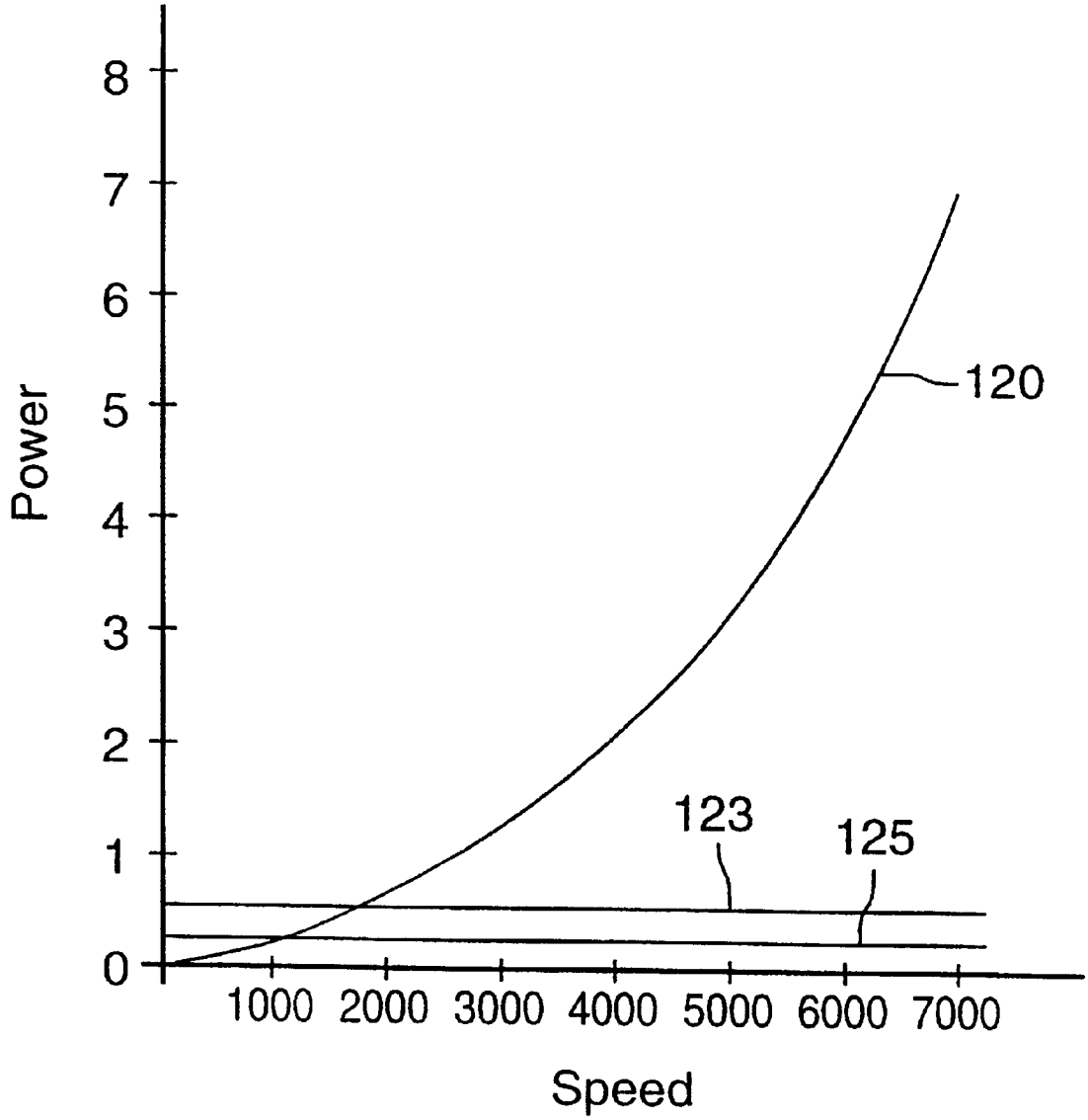
Figure 12:
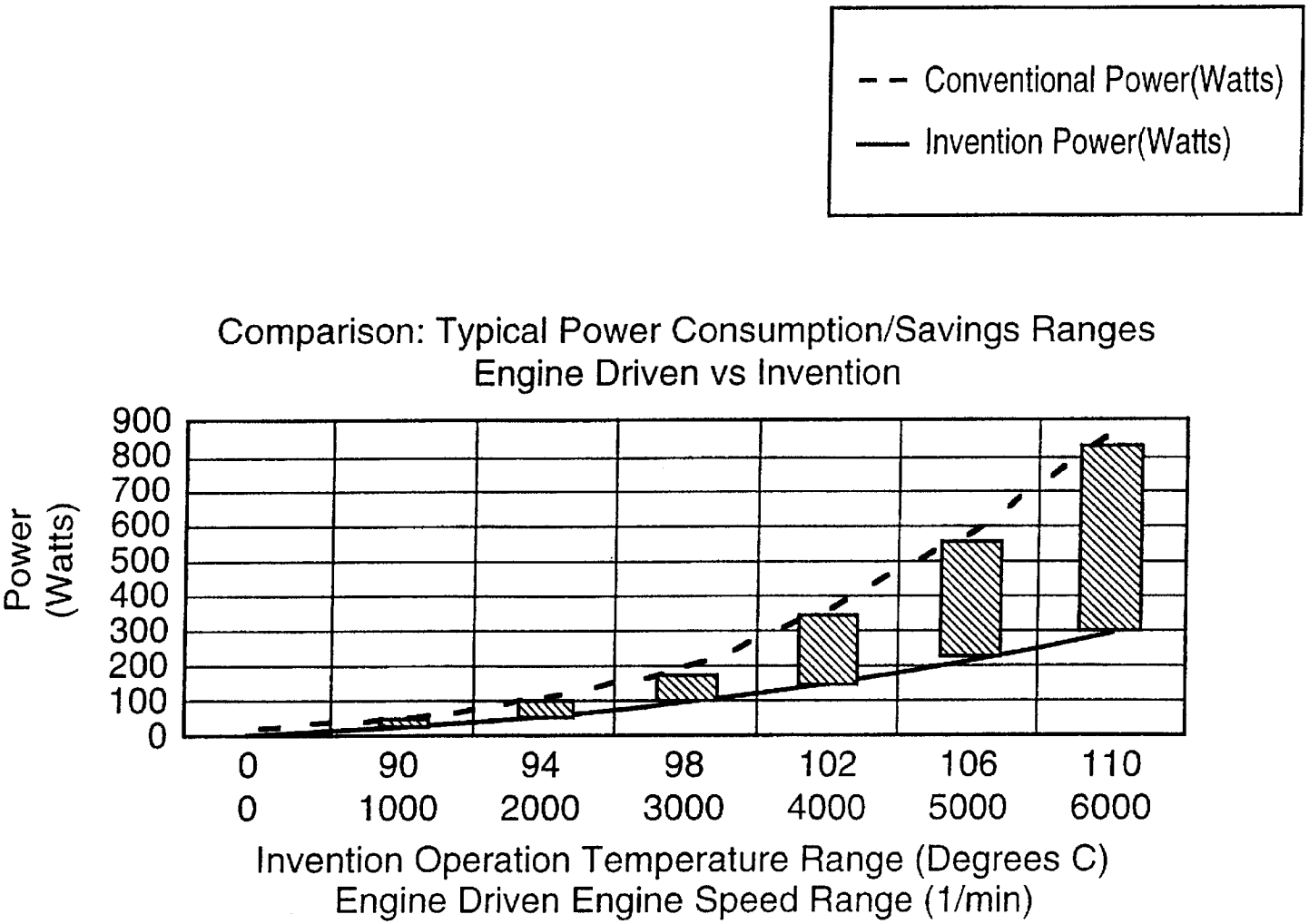

FIG. 2*a* is a close-up of an impeller of the pump;

FIG. 3 is a pictorial view in close up of the assembled components of the pump of FIG. 2;

FIG. 4 is a diagrammatic cross-sectioned side view of some of the components of the pump of FIG. 2;

FIG. 5 is an end elevation of some of the components of the pump of FIG. 2;

FIG. 6 is cross-section of another wafer pump which embodies the invention;

FIG. 7 is a cross-section on line A—A of FIG. 6;

FIG. 8 is a pictorial view of some of the components of the pump of FIG. 6;

FIG. 9 is a cross-section of another water pump which embodies the invention;

FIG. 10 is a plan view of some of the components of the pump of FIG. 9;

FIG. 11 is a graph showing a comparison of power consumption characteristics;

FIG. 12 is a graph showing a flow rate comparison.

The apparatuses shown in the accompanying drawings and described below are examples which embody the invention. It should be noted that the scope of the invention is defined by the accompanying claims, and not necessarily by specific features of exemplary embodiments.

Figure 1:
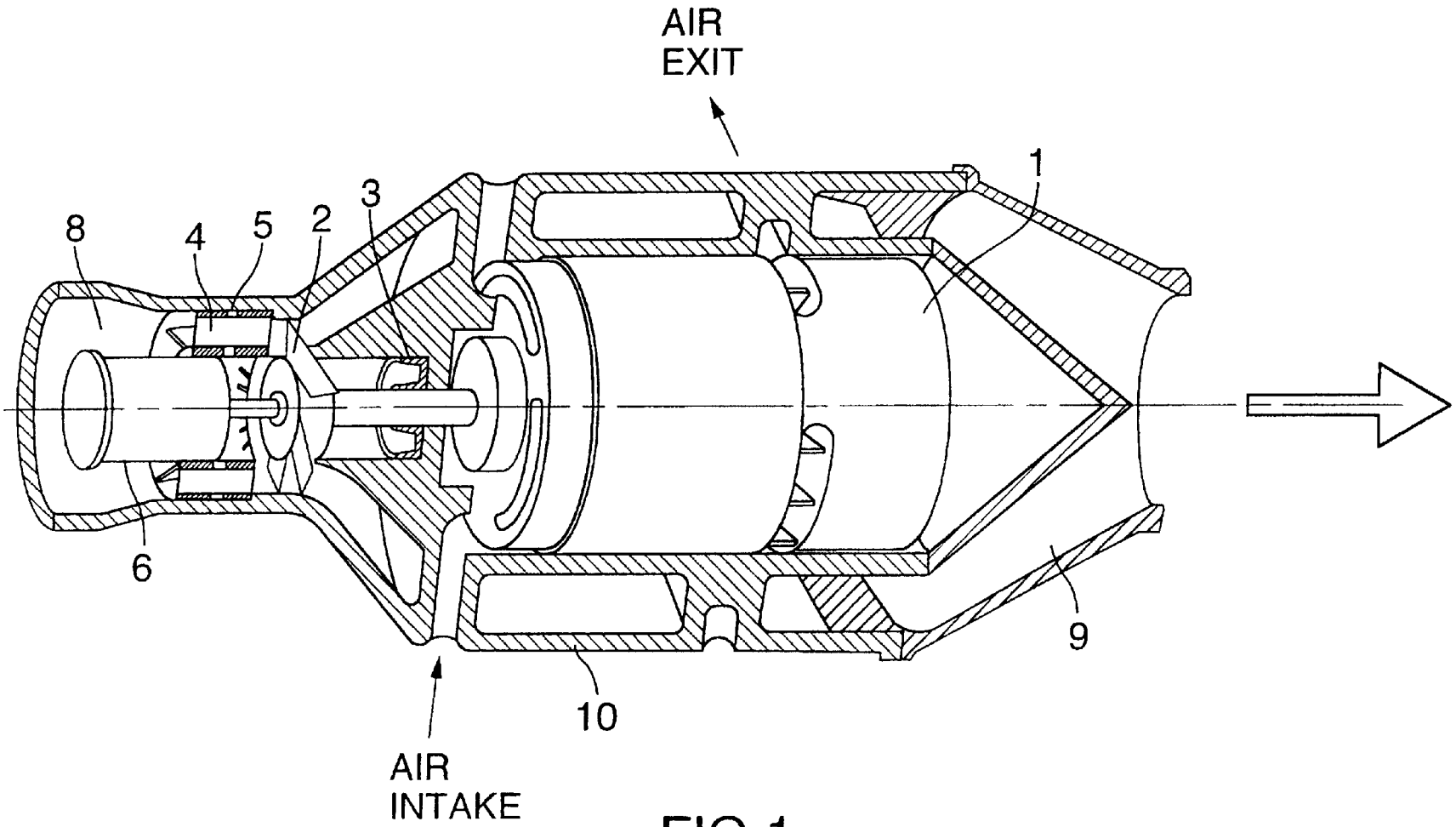
FIG. 1 is a pictorial cross-section of a water pump which embodies the invention.

As shown in FIG. 1, the motor 1 runs at a high speed, driving the impeller 2. A lip-seal 3 around the motor shaft seals the motor-pump interface between the motor 1 and the pump housing 10. The circular array of adjustable guide vanes 4 direct fluid flow from the fluid inlet passageway 8 onto the impeller 2. The impeller 2 then forces the fluid against the pump housing 10 towards the fluid outlet passageway 9.

The adjustable guide vanes 4 impart a variable degree of spin on the fluid flow depending on their angular displacement. The variable fluid flow spin ranges from negative to positive relative to the blades of the impeller 2. The degree of spin depends on the amount of angular displacement of the adjustable guide vanes 4. The angular displacement of the guide vanes corresponds to the amount of displacement of the guide vane linkage ring assembly 5. The guide vane linkage ring assembly 5 is displaced by the connected thermostatic element 6. Changes of temperature cause the thermostatic element 6 to expand or contract thus giving a corresponding displacement. A spring forces the thermostatic element 6 to return to its position of minimal displacement relative to its expansion-displacement force.

FIGS. 2–5 show an electrically driven water-pump that embodies the invention. The electric motor 20 is of the high speed (10,000 rpm or more) type, and typically draws a current, during normal operation, of between about 10 and 20 amps (at 12 volts). The body of the motor is bolted to a mounting plate 23. The shaft 25 of the motor is secured to a rotary impeller 27. The impeller 27 is shown in FIG. 2*a*, and is constructed preferably as a plastic or metal moulding.

The impeller 27 is placed in the path of coolant water flowing from the engine block via entry-passage 29. Water passing through the impeller is channeled away via exit-passage 30 (and thence passes to the radiator, etc).

Before reaching the impeller 27, water entering the impeller 27 first encounters a set of movable vanes 32. The designer provides that the vanes might be inclined in a sense whereby the vanes induce a rotary swirling motion into the water flow as the water flow enters the impeller. The vanes might be inclined in a first sense such that the swirling induced by the inclined vanes is in the same sense as, and reinforces, the rotary swirling produced by the impeller itself; or, the vanes might be inclined in the opposite sense, in which case the swirling induced by the vanes serves to oppose the swirling produced by the impeller.

By controlling the inclination of the blades, the output characteristics of the pump impeller can be controlled, in a smoothly progressive manner, and while the electric motor keeps the impeller rotating at more or less constant speed.

The inclination of the vanes is controlled by means of a thermostat 34, as will now be described.

Each vane 32 is secured to a respective vane-shaft 36, which is guided for rotation in a respective radially-disposed bore 38 in a fixed base plate 40. The outer end of each vane-shaft 36 carries a repective lever 43, by means of which the shaft 36 carries a respective lever 43, by means of which the shaft 36, and the vane 32, may be rotated.

The shaft-levers 43 are caused to rotate by the action of a rotor-ring 45. The rotorring 45 is mounted for rotation on the fixed base-plate 40. In fact, the rotor-ring is sandwiched between the fixed base-plate 40 and a fixed cover-plate 47. The two fixed plates 40,47 are bolted (at 46) to the mounting plate 23. The plates 40,47 are held apart by spacers 44, and the rotor-ring 45, which lies between the fixed plates, is movable relative thereto. The rotor-ring 45 is biassed in the anti-clockwise sense by means of springs 48.

The rotor-ring 45 is provided with notches 49, one for each of the shaft-levers 43 (five in this case). When the rotor-ring rotates, the five shaft-levers are dragged around and made to rotate their respective shafts 36 in unison with each other.

The rotor-ring 45 is caused to rotate by movement of the stem 50 of a thermostat 52. The distance the stem 50 protrudes from the body of the thermostat is proportional to the temperature of the water flowing over the body. The rotor-ring 45 thus rotates through an angle which is proportional to the temperature of the water, and similarly, the movable vanes 32 thereby lie at an angle of inclination which is proportional to the temperature of the water.

The thermostat 52 is of the type which contains an expandable body of wax. Such thermostats are readily available in a body size around 13 mm diameter, where the stem moves through approximately an 8 mm working stroke, between hot and cold. The movement of the stem is more or less proportional to the temperature, over the working stroke.

The thermostat is arranged to move the movable vanes 32, in this case, from an angle of about 50 degrees of with-the-impeller bias to an angle of about 25 degrees against-the-impeller bias. With-the-impeller bias is used to reduce the operation of the pump, whereby the pump delivers a smaller volumetric flow, and uses a smaller input energy; this is of use when the coolant is at cooler temperatures. Against-the-impeller bias is used to boost the flow of water through the pump impeller, which is of use when the water is starting to overheat.

The electric motor runs continuously while the engine is running, even when the engine coolant flow is at a minimum. Of course, the minimum coolant circulation flow is, and must be, a substantial flow: if the flow were allowed to approach zero flow conditions, the engine would quickly overheat.

In fact, one of the reasons a movable-vane system, as described, is so advantageous, is that the movable-vanes, even at the position where the flow is reduced to the maximum extent, still do permit a substantial flow. In the movable-vane system, the required flow adjustment is between two extremes of flow where even the lowest required flow is a long way from the zero flow condition. The movable-vanes system may be regarded as making it possible to make fine-tuning adjustments to what is a relatively large flow, in a refined and controllable manner, as distinct from switching a flow between on and off. Generally, it is regarded as quite demanding to obtain good linear control of a flow from, say, 60% of maximum, upwards. The movable-vane system does give excellent control and linearity over that range. It is recognised that this is just the characteristic that is required in an automotive water pump.

The mounting plate 23 includes cooling air passages, whereby the flow of cooling air over the motor is maximised, which is advisable in the case of a continuously-running motor. The flow of water emerging from the impeller passes radially outwards into the chamber 54. The mounting plate 23 includes fixed spacers 56, which provide space for the coolant to flow around and out of the passage 30.

The motor-shaft 25 carries a seal 58. The seal 58 must be designed for high shaft speeds: however, because the shaft diameter is small (e.g. 5 mm) the rubbing speed of the shaft on the seal is small, and in fact the seal 58 can be expected to have an adequate service life (as that expression is used in relation to automotive seals). The designer may prefer to provide a mechanical (rubbing) seal in place of the lip seal, if problems with lip-seals are feared. Another alternative is to provide a magnetic drive coupling from the electric motor to the impeller. Magnetic-drive couplings, which avoid the need for seals, are commonly available, and are not expensive, in the size of drive herein described.

FIG. 6 shows another type of water pump, which embodies the invention. In this case, water from the engine enters at port 60, and leaves through port 63. The incoming water flows around an annular passage 65 (FIG. 7). The electric motor 67 driving the impeller 69 is located internally of the annular passage 65.

The vanes induce a degree of rotary swirling motion of the water passing through the annular passage 65, as the water approaches the rotating impeller 69 (upwards in FIG. 6). The water flow can be biassed to swirl clockwise or anticlockwise in the annular passage 65, depending on the orientation of movable vanes 70. As shown in FIG. 7, the vanes are inclined to the left, whereby the water flow is biassed clockwise. Flow through the impeller 69, with the electric motor 67 set in the normal rotational sense, will be enhanced by a clockwise-biassed water flow. Inclining the vanes 70 to the right (FIG. 7) would reduce the water flow through the impeller, for a given speed of the motor. Again, even when the flow is reduced to a maximum extent, the flow is still substantial. The thermostat 72 senses the temperature of the flowing water, and adjusts the angle of the vanes 70 accordingly.

FIG. 8 shows how the thermostat 72 is configured so as to control the angular movement of the movable vane 70. The other vanes are linked by suitable connecting rods.

The FIG. 6 structure is suitable for fitment, as an insert, into the hoses which convey water on an automotive engine. As such, the unit may be fitted as a repair to a vehicle with a damaged water pump of the traditional belt-driven type. Alternatively, the FIG. 6 configuration may be incorporated as an OEM water pump.

FIGS. 9, 10 show another water pump which embodies the invention. The thermostat 89 acts upon a rotatable ring 90, in which are carried several movable vanes 92, mounted on spindles. The vane spindles terminate in respective tags 94, which engage corresponding slots 96 in the pump housing 98. Movement of the thermostat stem is effective to drag the ring around, and cause the vanes to rotate to a new orientation.

In some cases, the vanes are positioned in the flow of water leaving, rather than entering, the impeller. This gives a somewhat different characteristic of speed/motor-current/pressure/flow-rate/efficiency/etc. but one which may be more appropriate in some circumstances.

In the graph of FIG. 11, curve 120 shows the estimated power consumption of a typical conventional fixed-ratio, engine-driven coolant pump system, with the engine thermostat open. Curve 123 shows the estimated power consumption of a movable-vane, electric-motor driven pump system, of the type as described herein, in which the coolant flow-rate is boosted by the vanes. Curve 125 is of the same thing, in which the flow rate is reduced by the vanes. The new system can provide a constant coolant flow rate, independent of engine speed, even down to zero engine speed: in the new system, the flow rate changes in response to a change in temperature of the coolant, and the new system is arranged to increase or reduce the flow-rate of the coolant as the temperature goes up or down.

FIG. 12 is another graph showing as estimation of the improvement of the new pump system over a conventional system.

Some further benefits of the coolant flow control systems as described herein will now be described.

1. Improved control of engine temperature. Most conventional engine driven systems rely on fan-airflow modulation of the airflow across the radiator to maintain engine coolant temperature within a specified operating range. Controlling the temperature within tight limits allows overall engine efficiency to be improved. Minimizing the temperature operating range is a design objective because of the inherent engine performance benefits associated with operation at optimal temperatures, such as better combustion etc. Also, the tighter control of coolant temperature by the new pump system may be expected to lead to a reduced need for modulation from the fan.

2. Coolant pump efficiency. The amount of energy spent on cooling, aggregated over the entire operating range, is considerably reduced.

3. Improved heater performance. At idle, conventional engine-driven pumps commonly deliver insufficient coolant to the heater-core resulting in poor cabin heater performance. The new system can be designed to have a minimum flow-rate tuned for a given system resistance and higher flow through the heater core to boost cabin heater performance during warm-up.

4. After-run cooling capability. An electrically driven pump, as depicted herein, can be switched to provide after-run cooling. After-run cooling occurs when the engine is shut down and therefore cooling cannot be provided by means of an engine-driven pump. A simple thermal switch similar to that used for the switching off a conventional cooling fan could be employed here. After shutdown, when enginedriven pumps no longer function, conventional engines sometimes experience a large temperature rise referred to as after-boil, even though the electric cooling fan may still be running, to cool the radiator: the residual heat is present in the engine block and head, not in the radiator. Excessive after-boil can cause premature deterioration of components and fluids. Some engines have even had special electric coolant pumps fitted, in addition to the conventional belt-driven coolant pump, just to keep the coolant circulating for a few minutes after the engine stops. Similarly, if an engine is fitted with a cold weather pre-heater to warm the engine prior to starting, an electric pump is advantageous in that it can be switched on to circulate the coolant prior to starting.

5. Cost advantages. A conventional water pump requires a belt drive, robust bearings, and generally an elaborate and costly infrastructure, although the pump itself is quite cheap. Also, the conventional system is labour-intensive on the assembly line. The present system, as a pre-manufactured self-contained unit, is simply bolted onto the engine block, and requires virtually no other assembly-line work. The unit also is lighter in weight overall than the belt-driven unit. A high-speed, low-torque drive (which are the characteristics that lead to lightness) is simple with an electric motor drive, but not possible with a belt drive.

6. Versatility. A conventional water pump is restricted as to its mounting position and manner of driving. The new pumping system may be configured to be installed by bolting it to the engine block, or the unit may be configured to be inserted into the plumbing arrangements of the engine. The motor driving the new system preferably is constant-speed, as described; all the variation in flow being derived from varying the orientation of the vanes. But the system could be configured to utilise a two-speed or multi-speed motor, or even a steplessly-variable-speed motor if the needed sophisticated controls are included.

7. Range of operation. Typically, an automotive engine requires the coolant flow to vary between about 10 and 30 gallons a minute. The system as described can provide that level of flow, and that variation in the level of flow, in an inexpensive, self-contained unit.

8. Reliability. The system as described herein is intended to replace the belt driven coolant pump, not to supplement it. Modern electric motors, even high-speed designs, are very reliable. By contrast, a conventional belt-driven water pump, in order to reach its present state of acceptable reliability (i.e. reliability in the very demanding automotive sense), has had to be over-engineered to a considerable degree. Of course, electrical components can fail, and a failed water pump can quickly lead to engine damage. But the outcome of a reliability comparison between an electrical component that runs at more or less constant speed, and a mechanical belt drive, is all too clear. Wax-type thermostats are cheap, and very reliable. In the case where the vane orientation is operated by an electronic engine-management system, it is noted that such systems are becoming increasingly reliable, and the systems as described herein are able to take advantage of that (which a mechanical belt-drive is not).

In this specification, it has been suggested that the electric motor may run at constant speed. However, this is not to say that a real, practical motor, does indeed operate at constant speed. Rather the emphasis is that the invention provides a means for controlling the flow of coolant, wherein the flow is controlled by a means other than by controlling the speed of the pump. That is to say, the motor and the pump are enabled to run at constant speed, and still the flow rate of the coolant can be varied. Whether or not the speed of the motor actually is constant depends on the characteristics of the motor. The conventional type of 12-volt DC motor currently in widespread use for operating accessories on automobiles is suitable.

Also, in this specification, the relationship of flow-rate vs temperature, and the linearity of the components of the relationship, has been described as linear: this is expressed substantively, not absolutely. For example: a wax-type thermostat has only an approximately linear relationship between temperature change and distance moved. Similarly, in the pump, the relationship of the coolant flow rate to the change in angular orientation of the vanes, is more a raised-power relationship, rather than linear. However, the relationships are described as more or less linear in the context of, for example, a conventional flow-controlling butterfly valve, which is so grossly nonlinear that automatic control of the flow-rate is barely contemplatable.

What is claimed is:

1. A liquid-pumping apparatus, which is so constructed as to be suitable for incorporation into an engine having a liquid-cooled cooling system containing a quantity of a liquid coolant, the apparatus being suitable for circulating the coolant, wherein:

the apparatus includes a rotatable impeller, mounted in a fixed housing;

the housing defines a pump chamber, in which the coolant being pumped is conveyed through the impeller;

the apparatus includes a means for rotating the impeller;

the apparatus includes a movable swirl-inducing means;

the movable swirl-inducing means is so located in relation to the impeller as to be effective to impart a bias condition onto the flow of coolant passing through the impeller;

the movable swirl-inducing means is movable through a range of conditions, between a flow-reducing bias condition and a flow-boosting bias condition;

the movable swirl-inducing means is so arranged in conjunction with the impeller as to induce, during operation of the pump, a biassing swirl in the flow of liquid passing through the impeller;

the movable swirl-inducing means is so arranged that movement thereof produces a corresponding change in the degree of swirl bias induced;

the apparatus includes a temperature-transducer, having an output member;

the output member is movable through a range of positions, in response to changes in temperature of the coolant, between a cold-liquid position and a hot-liquid position of the output member;

the apparatus includes a connecting means, which operatively connects the output member of the temperature transducer to the movable swirl-inducing means, whereby movement of the output member produces a corresponding movement of the movable swirl-inducing means;

the connecting-means comprises a means for moving the movable swirl-inducing means;

the apparatus is so arranged that when the output member of the temperature is in the cold-liquid position, the movable swirl-inducing means is in the flow-reducing bias condition, and when the movable member is in the hot-liquid position, the movable swirl-inducing means is in the flow-boosting bias condition.

2. Apparatus of claim 1, wherein the movable swirl-inducing means lies upstream of the impeller.

3. Apparatus of claim 1, wherein the means for rotating the impeller comprises an electric motor.

4. Apparatus of claim 3, wherein the apparatus includes a supply means for supplying electric power to the electric motor, and the supply means is effective, in operation, to keep the rotational speed of the motor substantially constant.

5. Apparatus of claim 3, wherein the electric motor is effective to rotate the impeller, during operation, at a speed in excess of 10,000 rpm.

6. Apparatus of claim 3, wherein the electric motor is co-axial with the impeller, and drives the impeller directly.

7. Apparatus of claim 6, wherein:

the housing provides a portion of the pump chamber, which portion is of annular cross-section, and which is located downstream of the impeller;

the portion comprises inner and outer cylindrical walls, and the inner cylindrical wall defines a motor chamber therewithin;

the electric motor is located in the motor chamber;

the apparatus includes an air-circulation system, which is effective to circulate cooling air over and around the electric motor.

8. Apparatus of claim 1, wherein:

the movable swirl-inducing means is mounted in the fixed housing of the apparatus, for guided movement therein;

the temperature sensor and the output member are combined in a thermostat unit;

the thermostat unit includes a bulb, which, in operation of the pump, is located within, and is sensitive to the temperature of, the coolant being pumped;

the output member comprises a plunger of the thermostat unit;

the thermostat unit is fixedly mounted in the fixed housing of the apparatus;

and the connecting means comprises a direct mechanical connection between the plunger and the movable swirl-inducing means.

9. Apparatus of claim 1, wherein:

the movable swirl-inducing means comprises a set of movable vanes;

the movable vanes are mounted on respective spindles mounted in a ring member;

the spindles have respective levers;

the apparatus includes a plate member, which engages the levers;

one of the ring and plate members is movable, the other being fixed, and the connecting means connects the output member of the temperature transducer to the movable one of the members;

the fixed one of the ring and plate members is fixedly mounted in the fixed housing of the apparatus;

and the connecting means comprises a direct mechanical connection between the plunger and the movable one of the ring and plate members.

10. Apparatus of claim 1, wherein the temperature transducer includes a temperature sensor, and includes a means for transmitting temperature signals from the sensor to the output member.

11. Apparatus of claim 1, wherein:

the temperature sensor and the output member are combined in a thermostat unit;

the thermostat unit includes a bulb, which, in operation of the pump, is located within, and is sensitive to the temperature of, the coolant being pumped;

the output member comprises a plunger of the thermostat unit.

12. Apparatus of claim 1, wherein:

the temperature-sensor is effective to provide an electrical signal indicative of temperature;

the output-member is an electric-actuator-means, and the transducer includes a means for relating the magnitude of output of the electric-actuator-means to the level of the signal.

13. Apparatus of claim 1, wherein the electric-actuator-means is a servomotor.

14. Apparatus of claim 1, wherein the electric-actuator-means is a solenoid.

15. Apparatus of claim 1, wherein the arrangement of the apparatus is such that, during operation, when the movable swirl-inducing means is in an extreme flow-reducing bias condition, that the flow of coolant through the chamber is substantial.

16. Apparatus of claim 15, wherein the arrangement of the apparatus is such that, during operation, when the movable swirl-inducing means is in the liquid-flow-boosting bias condition, the flow of coolant through the chamber is more than twice the corresponding flow through the chamber when the movable swirl-inducing means is in the flow-reducing bias condition.

17. Apparatus of claim 1, wherein:

the motor is encased within a cylindrical double-walled tubular fluid flow chamber around its circumference which extends from the outlet area from the impeller to an outlet flange area of the fluid flow chamber;

the said outlet flange area integrates the double-walled tubular fluid flow passageway with a single walled tubular outlet embodiment;

the said tubular outlet embodiment is configured to allow mounting integration of the pump as well as sealed fluid passageway through which the system fluid leaves the pump and enters the adjoining cooling system component.

18. Apparatus of claim 1, in combination with an automobile engine of the type having a liquid-cooled cooling system, and containing a quantity of a liquid coolant, wherein the pump apparatus is so arranged as to circulate the coolant.

19. Apparatus of claim 18, wherein the pump apparatus is configured as an integral whole unit, and the apparatus includes a means for affixing the unit directly to the block of the engine.

20. A liquid-pumping apparatus, wherein:

the apparatus includes a rotatable impeller, mounted in a fixed housing;

the housing defines a pump chamber, in which liquid being pumped is conveyed through the impeller;

the apparatus includes a motor means, for rotating the impeller;

the apparatus includes a flow-deflector;

the flow-deflector is so located in relation to the impeller as to be effective to impart a bias condition onto the flow of liquid passing through the impeller;

the flow-deflector is movable through a range of conditions, between a flow-reducing bias condition and a flow-boosting bias condition;

the apparatus includes a temperature-transducer, having an output member;

the output member is movable through a range of positions, in response to changes in temperature of the liquid, between a cold-liquid position and a hot-liquid position of the output member;

the apparatus includes a connecting means, which operatively connects the output member of the temperature transducer to the flow-deflector, whereby movement of the output member produces a corresponding movement of the flow-deflector;

the apparatus is so arranged that when the output member of the temperature transducer is in the cold-liquid position, the flow-deflector is in the flow reducing bias condition, and when the movable member is in the hot-liquid position, the flow-deflector is in the flow-boosting bias condition;

the motor means comprises an electric motor;

the apparatus includes a supply means for supplying electric power to the electric motor, and the supply means is effective, in operation, to keep the rotational speed of the motor substantially constant.

* * * * *